US008540593B1

(12) United States Patent
Marnane

(10) Patent No.: US 8,540,593 B1
(45) Date of Patent: Sep. 24, 2013

(54) BASEBALL TRAINING DEVICE

(76) Inventor: Timothy J. Marnane, Providence, RI (US)

( * ) Notice: Subject to any disclaimer, the term of this patent is extended or adjusted under 35 U.S.C. 154(b) by 256 days.

(21) Appl. No.: 13/198,184

(22) Filed: Aug. 4, 2011

(51) Int. Cl.
*A63B 69/40* (2006.01)

(52) U.S. Cl.
USPC ..... 473/454

(58) Field of Classification Search
USPC ..... 473/454–456, 154, 164, 167, 170, 473/172, 190; 124/6, 7; 273/108.3
See application file for complete search history.

(56) References Cited

U.S. PATENT DOCUMENTS 4,629,188 A 12/1986 Mahieu
5,062,640 A * 11/1991 Haley ..... 473/168
5,333,856 A 8/1994 Gery
5,370,386 A * 12/1994 Parks ..... 473/446
5,433,434 A 7/1995 Helmetsie
5,484,145 A * 1/1996 Shriver ..... 473/454
5,573,240 A 11/1996 Humboldt
5,803,841 A 9/1998 Daskoski
7,217,202 B2 * 5/2007 Troxell ..... 473/451

* cited by examiner

*Primary Examiner* — Gene Kim
*Assistant Examiner* — Amir Klayman

(57) ABSTRACT

The baseball training device provides a framed net for capturing thrown balls, especially baseballs. The frame is sturdily supported by stanchions that include upwardly extended sections for additional support. The fasteners are fastened to the frame sides. The device includes a substantially centrally disposed target box. The target box is supported by spaced apart uprights. The uprights feature orifices and the target box, ears, whereby keepers may be passed from the ears into a given set of upright orifices to thereby adjust the vertical positioning of the target box. The device provides padded horizontal members that are fitted as desired, one atop another, in order to effectively shorten the box height and thereby establish a smaller target for a thrower.

3 Claims, 7 Drawing Sheets

BASEBALL TRAINING DEVICE

BACKGROUND OF THE INVENTION

Pitching coaches, and for that matter any coach who is instructing baseball players in throwing and throwing accuracy have been limited by retrieval, or by having to have someone to catch thrown balls. Further, the coaches and the thrower need to be able to discern accuracy quickly and easily as well as tailor any drill for accuracy within a given set of dimensions, that is, height and width. The present device provides an adjustable target, in both size and height, and a frame with net for trapping thrown balls. Hitting coaches can use the device to teach disciplined (zone) hitting depending on the count. If the count is in the hitters favor, he should not be swinging at thrown balls that do not go in his adjustable strike zone (target box). As the count favors the pitcher, the hitter's strike zone increases. The zone will be determined by the players age and ability level.

FIELD OF THE INVENTION

The baseball training device relates to baseball and other throwing ball sports and more especially to a training device that provides a net for trapping a ball and an adjustable target box.

SUMMARY OF THE INVENTION

The general purpose of the baseball training device, described subsequently in greater detail, is to provide a baseball training device which has many novel features that result in an improved baseball training device which is not anticipated, rendered obvious, suggested, or even implied by prior art, either alone or in combination thereof.

To attain this, the baseball training device provides a framed net for capturing thrown balls, especially baseballs. The frame is sturdily supported by stanchions. The stanchions may include upwardly extended sections for additional support, and may also include a pair of fasteners for each stanchion, the fasteners fastened to the frame sides. The device may include a substantially centrally disposed target box. The target box may be supported by spaced apart uprights. The uprights may feature orifices and the target box, ears, whereby keepers may be passed from the ears into a given set of upright orifices to thereby adjust the vertical positioning of the target box. The device may also provide padded horizontal members that are fitted as desired, one atop another, in order to shorten the box height and thereby establish a smaller target for a thrower. The horizontal members may be stacked in a number of ways. The ideal stacking capability may include spaced apart downwardly projected inserts on each horizontal member and u-brackets on each horizontal member. The horizontal members may be fitted between the uprights. When provided, the padded receiver member and padded horizontal members aid in preventing thrown ball ricochet.

The device provides sturdy rigidity in the frame and stanchions, as well as ease of adjustability for target box height and the size of the target box Thus has been broadly outlined the more important features of the improved baseball training device so that the detailed description thereof that follows may be better understood and in order that the present contribution to the art may be better appreciated.

An object of the baseball training device is to capture thrown balls.

Another object of the baseball training device is to provide a target for thrown balls.

A further object of the baseball training device is to provide an adjustable sized target for thrown balls.

An added object of the baseball training device is to provide a target box that is selectively vertically positioned.

And, an object of the baseball training device is to be especially useful for thrown baseballs.

These together with additional objects, features and advantages of the improved baseball training device will be readily apparent to those of ordinary skill in the art upon reading the following detailed description of presently preferred, but nonetheless illustrative, embodiments of the improved baseball training device when taken in conjunction with the accompanying drawings.

DETAILED DESCRIPTION OF THE DRAWINGS

With reference now to the drawings, and in particular FIGS. 1 through 7 thereof, the principles and concepts of the baseball training device generally designated by the reference number 10 will be described.

Figure 1:
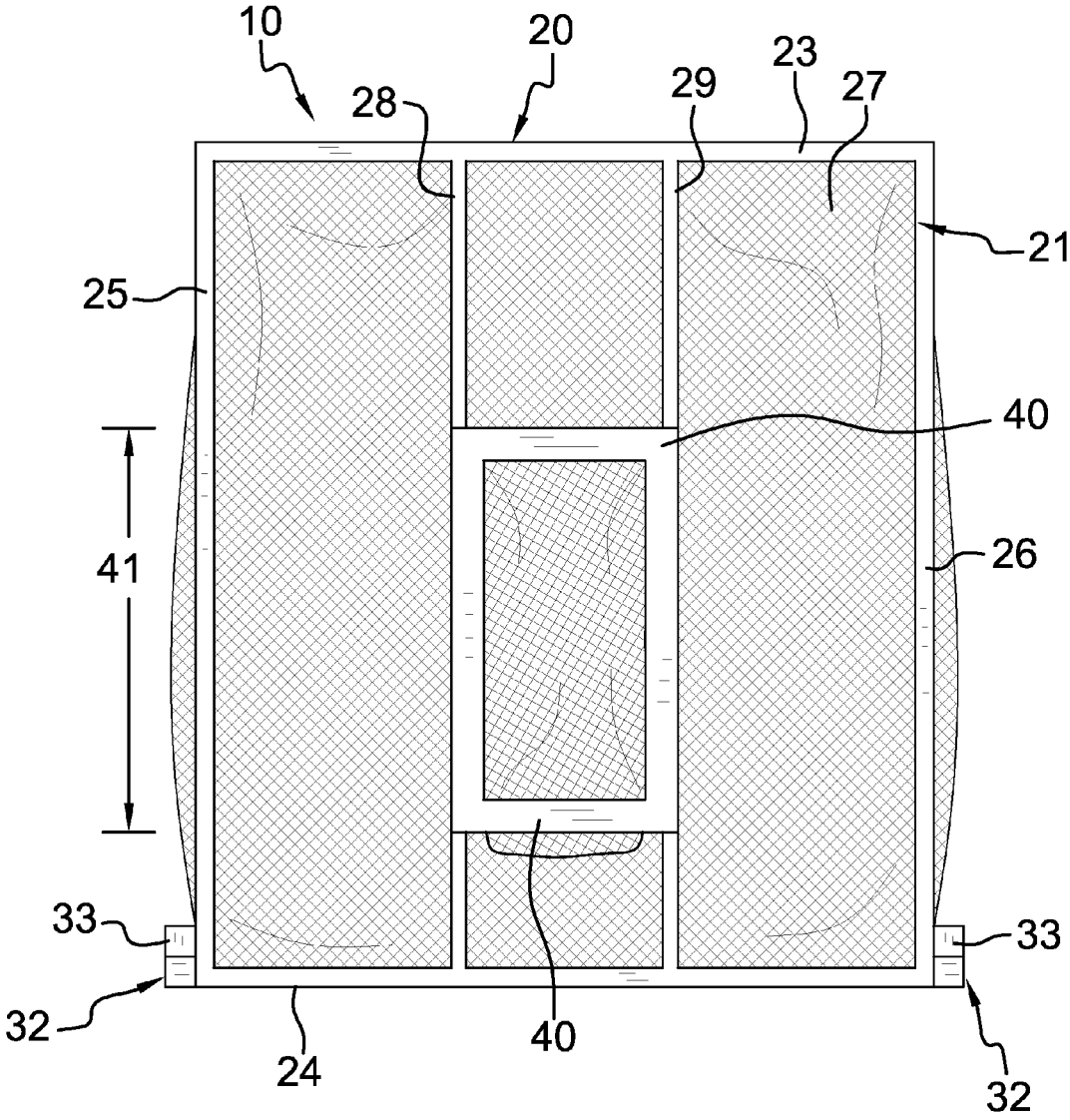
FIG. 1 is a front elevation view.

Referring to FIG. 1, the device 10 partially comprises the frame 20. The frame 20 has a front 21.

Figure 2:
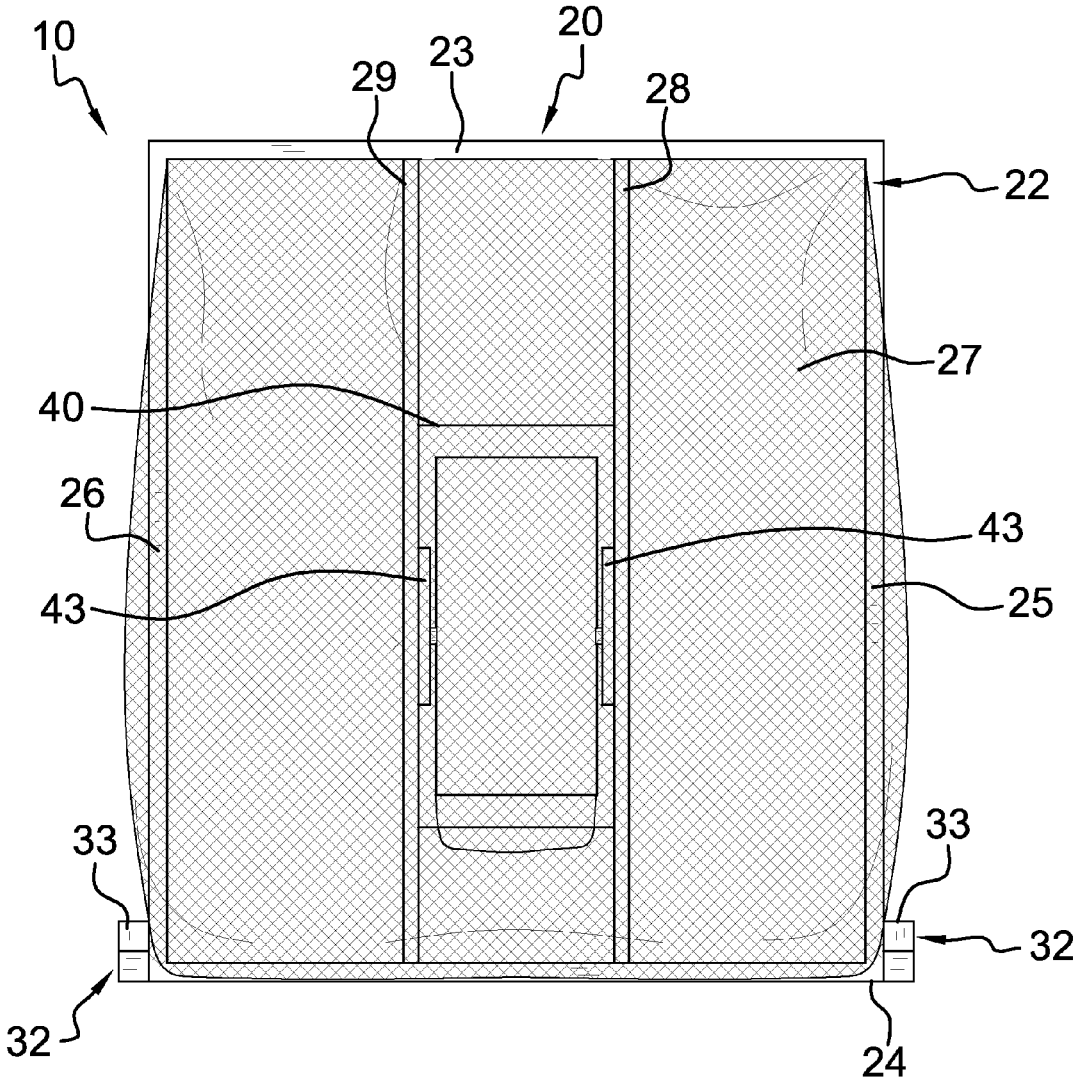
FIG. 2 is a back elevation view.

Referring to FIG. 2, the frame 20 front 21 is spaced apart from the back 22. The top 23 is spaced apart from the bottom 24. The first side 25 is spaced apart from the second side 26.

Figure 5:
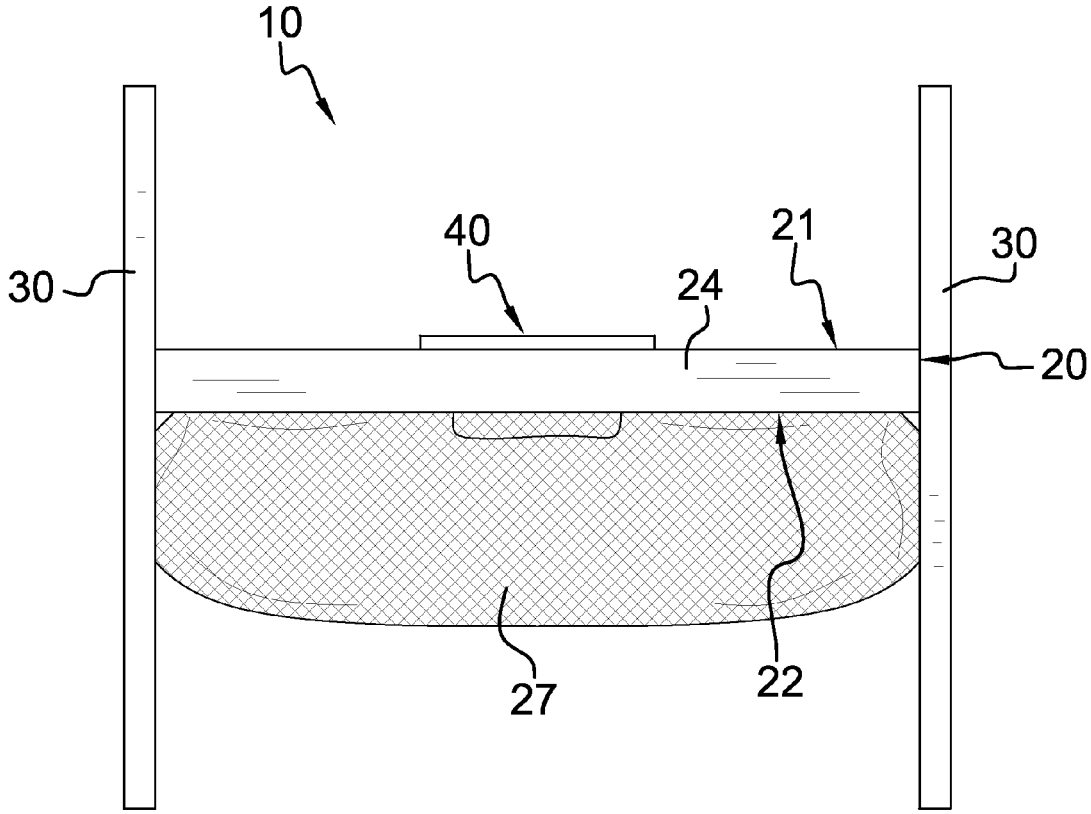
FIG. 5 is a bottom plan view.

Referring to FIG. 5, the net 27 is loosely suspended across the back 22 of the frame 20.

Figure 6:
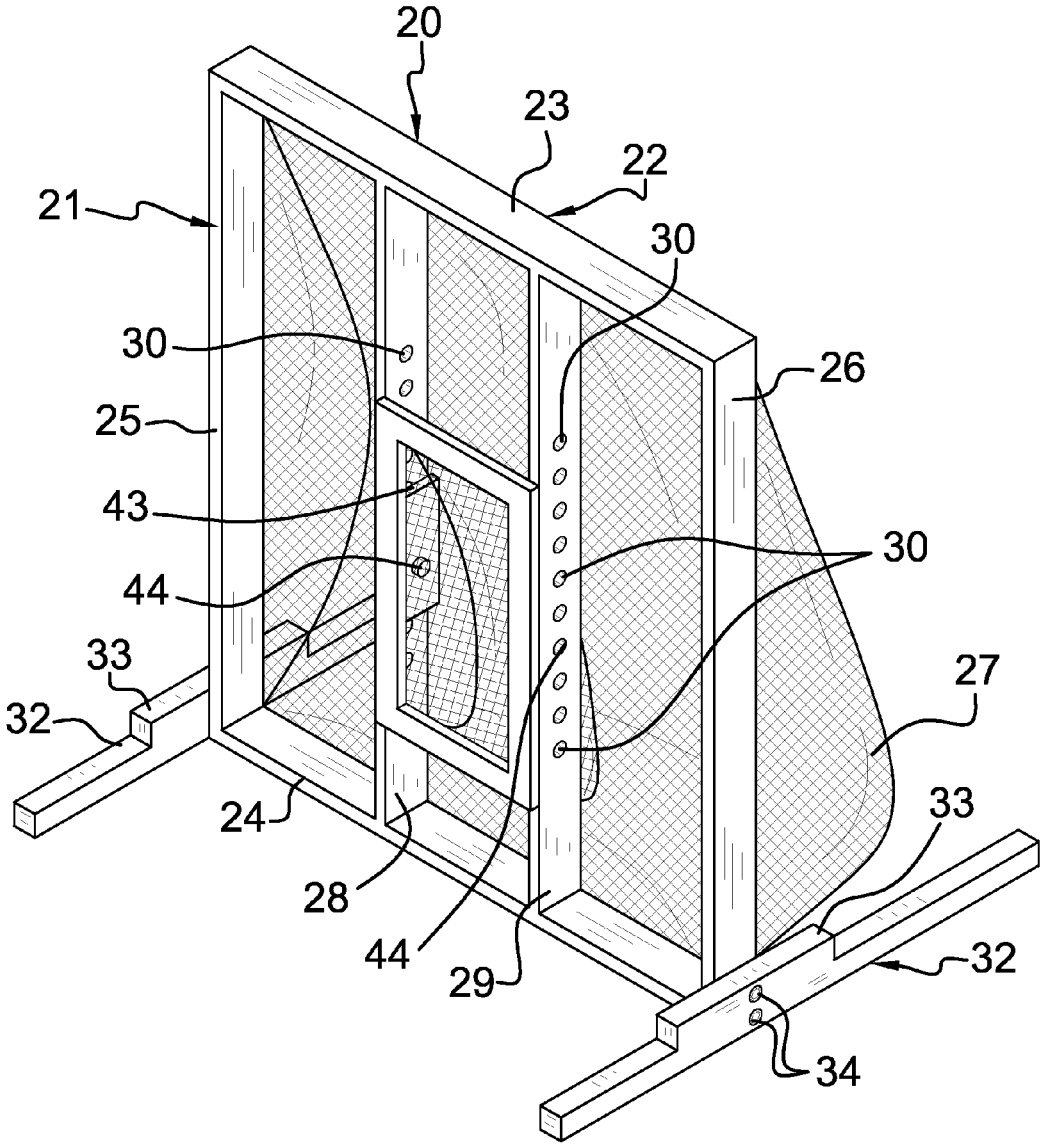
FIG. 6 is a front perspective view.
Figure 7:
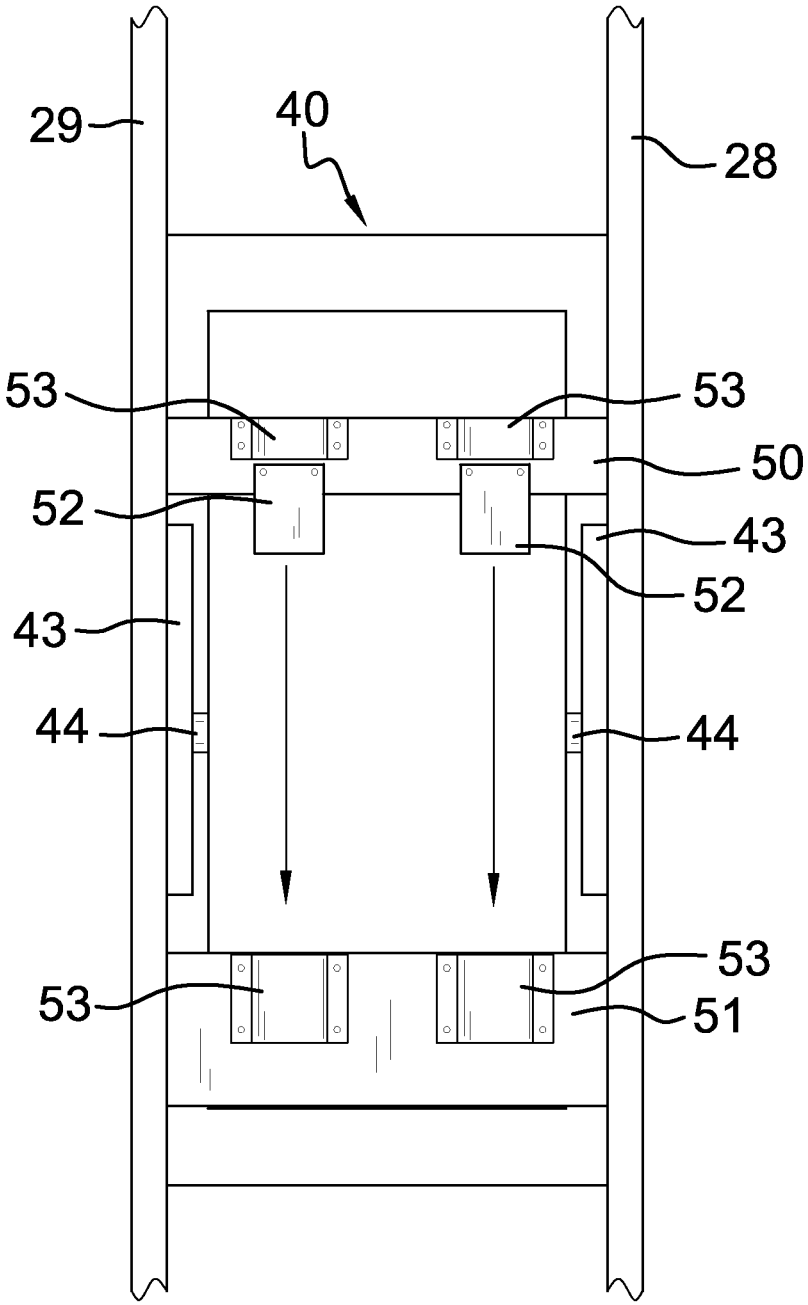
FIG. 7 is a back elevation view.

Referring to FIG. 6, the pair of spaced apart uprights is disposed centrally within the frame 20. The uprights comprise the first upright 28 and the second upright 29. The uprights are attached to the frame 20 top 23 and the frame 20 bottom 24. A plurality of spaced apart orifices 30 is evenly disposed within each upright.

Figure 3:
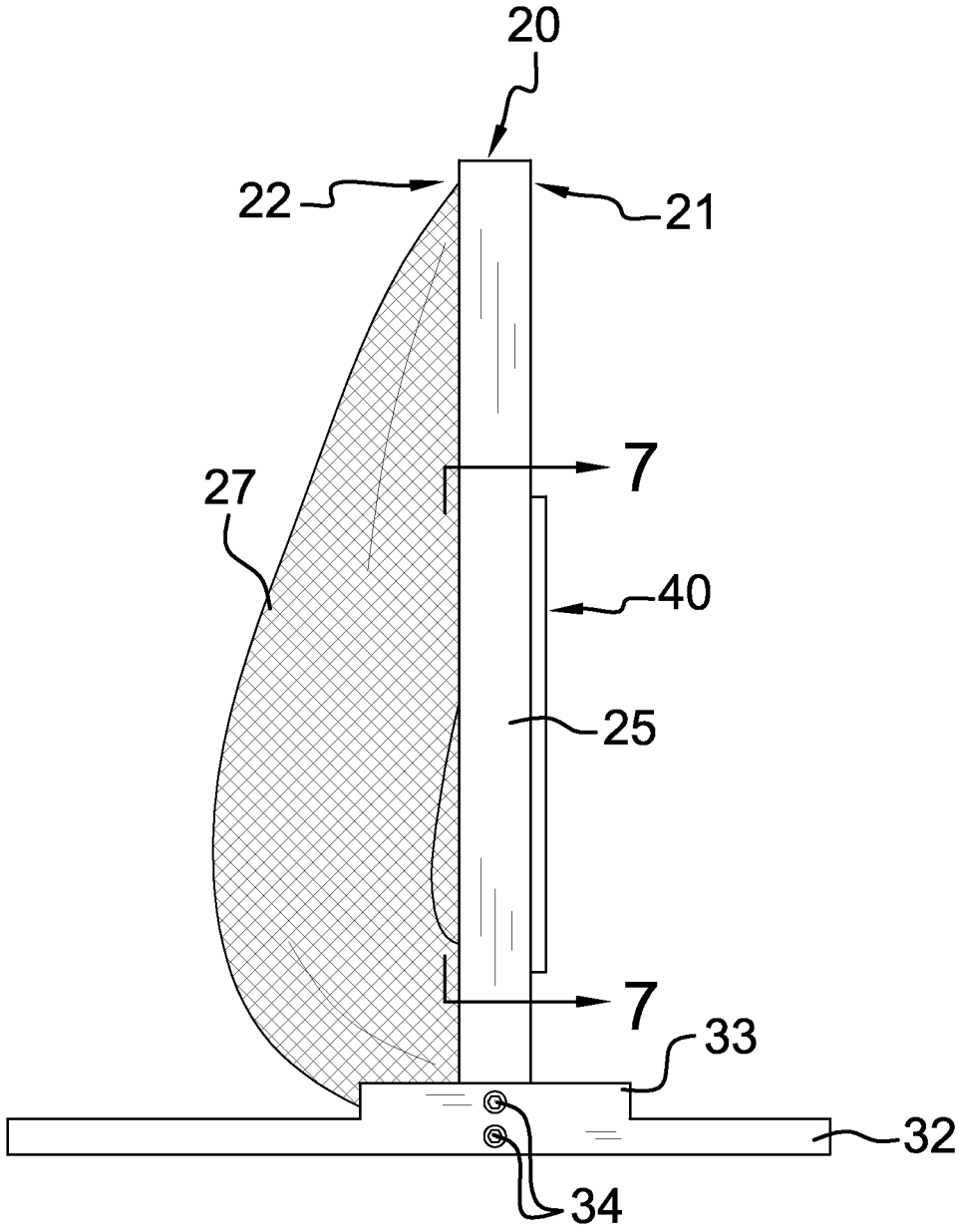
FIG. 3 is a lateral elevation view.
Figure 4:
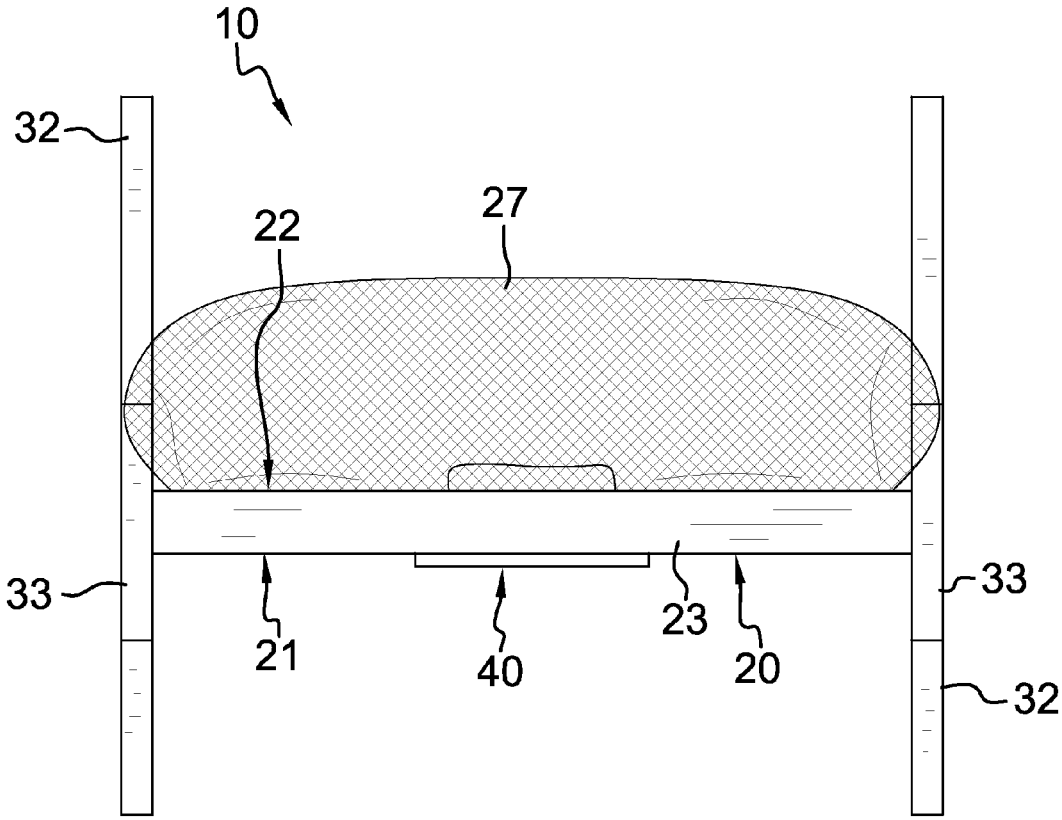
FIG. 4 is a top plan view.

Referring to FIG. 3 and FIG. 4, a stanchion 32 supports each frame 20 side. Each stanchion 32 further comprises an upwardly extended section 33. One of each stanchion 32 is affixed to one of each of the sides via two spaced apart fasteners 34 to ensure rigidity.

Referring again to FIG. 1, the target box 40 has a box height 41;

Referring to FIG. 2 and FIG. 6, a pair of box ears 43 is provided. One of each box ear 43 is projected rearwardly from an opposite side of the target box 40. The box ears 43 are fitted adjacent to and within the uprights.

Referring to FIG. 7 and again to FIG. 6, more than one keeper 44 is provided. Each keeper 44 selectively and removably vertically locates the target box 40 within the uprights via the orifices 30.

Referring again to FIG. 7, the padded receiver member 51 is disposed downwardly and rearwardly on the target box 40. A pair of spaced apart vertically disposed u-brackets 53 is disposed on the receiver member 51. A plurality of padded horizontal members 50 is provided. Each padded horizontal member 50 further comprises a pair of spaced apart vertically disposed u-brackets 53. The horizontal member u-brackets 53 are disposed in alignment with the receiver member 51 u-brackets 53. A pair of spaced apart inserts 52 is provided for each horizontal member 50. The inserts 52 are disposed in alignment with the u-brackets 53. Each pair of inserts 52 removably inserts with one of the pairs of u-brackets 53 of the receiver member 51. Each pair of inserts 52 of the padded horizontal members 50 further is removably inserted into the u-brackets 53 of one of the padded horizontal members 50. The target box height 41 is thereby effectively reduced.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the baseball training device may be used.

What is claimed is:

1. A baseball training device comprising, in combination:

a frame having a front spaced apart from a back, a top spaced apart from a bottom, and a first side spaced apart from a second side;

a net loosely suspended across the back of the frame;

a pair of spaced apart uprights disposed centrally within the frame, the uprights comprising a first upright and a second upright, the uprights attached to the frame top and the frame bottom;

a plurality of spaced apart orifices evenly disposed within each upright;

a stanchion supporting each frame side;

a target box having a box height;

a pair of box ears, a one of each box ear projected rearwardly from an opposite side of the target box, the box ears fitted adjacent to and within the uprights;

a more than one keeper, each keeper selectively and removably vertically locating the target box within the uprights via the orifices;

a receiver member disposed downwardly and rearwardly on the target box;

a pair of spaced apart vertically disposed u-brackets disposed on the receiver member;

a plurality of horizontal members, each horizontal member further comprising:

a pair of spaced apart vertically disposed u-brackets, the horizontal member u-brackets disposed in alignment with the receiver member u-brackets;

a pair of spaced apart inserts, the inserts disposed in alignment with the u-brackets, each pair of inserts removably inserted with one of the pairs of u-brackets of the receiver member, each pair of inserts of the horizontal members further removably inserted into the u-brackets of one of the horizontal members;

whereby the target box height is selectively and effectively reduced.

2. The device according to claim 1 wherein each stanchion further comprises an upwardly extended section, one of each stanchion affixed to one of each of the sides via two spaced apart fasteners.

3. A baseball training device comprising, in combination:

a frame having a front spaced apart from a back, a top spaced apart from a bottom, and a first side spaced apart from a second side;

a net loosely suspended across the back of the frame;

a pair of spaced apart uprights disposed centrally within the frame, the uprights comprising a first upright and a second upright, the uprights attached to the frame top and the frame bottom;

a plurality of spaced apart orifices evenly disposed within each upright;

a stanchion supporting each frame side, each stanchion further comprising an upwardly extended section, one of each stanchion affixed to one of each of the sides via two spaced apart fasteners;

a target box having a box height;

a pair of box ears, a one of each box ear projected rearwardly from an opposite side of the target box, the box ears fitted adjacent to and within the uprights;

a more than one keeper, each keeper selectively and removably vertically locating the target box within the uprights via the orifices;

a padded receiver member disposed downwardly and rearwardly on the target box;

a pair of spaced apart vertically disposed u-brackets disposed on the padded receiver member;

a plurality of padded horizontal members, each padded horizontal member further comprising:

a pair of spaced apart vertically disposed u-brackets, the padded horizontal member u-brackets disposed in alignment with the receiver member u-brackets;

a pair of spaced apart inserts, the inserts disposed in alignment with the u-brackets, each pair of inserts removably inserted with one of the pairs of u-brackets of the padded receiver member, each pair of inserts of the padded horizontal members further removably inserted into the u-brackets of one of the padded horizontal members;

whereby the target box height is selectively and effectively reduced.

* * * * *